US009653024B1

(12) United States Patent
Kuo et al.

(10) Patent No.: US 9,653,024 B1
(45) Date of Patent: May 16, 2017

(54) METHOD OF COMPENSATING AMOLED IR DROP AND SYSTEM

(71) Applicant: Shenzhen China Star Optoelectronics Technology Co., Ltd., Shenzhen (CN)

(72) Inventors: Pingsheng Kuo, Shenzhen (CN); Liwei Chu, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 148 days.

(21) Appl. No.: 14/771,802

(22) PCT Filed: Jun. 24, 2015

(86) PCT No.: PCT/CN2015/082166
§ 371 (c)(1),
(2) Date: Aug. 31, 2015

(87) PCT Pub. No.: WO2016/187919
PCT Pub. Date: Dec. 1, 2016

(30) Foreign Application Priority Data

May 28, 2015 (CN) ..... 2015 1 0284710

(51) Int. Cl.
*G09G 3/3258* (2016.01)
*G09G 3/3233* (2016.01)

(52) U.S. Cl.
CPC ..... *G09G 3/3233* (2013.01); *G09G 3/3258* (2013.01); *G09G 2320/0233* (2013.01); *G09G 2320/04* (2013.01); *G09G 2330/02* (2013.01)

(58) Field of Classification Search
CPC ..... G09G 2320/043; G09G 2320/045; G09G 2320/06; G09G 2320/04; G09G 3/3233
See application file for complete search history.

(56) References Cited

U.S. PATENT DOCUMENTS 7,239,308 B2 * 7/2007 Satoh ..... G09G 3/22 345/204
8,149,230 B2 * 4/2012 Lee ..... G02F 1/136286 345/211

(Continued)

FOREIGN PATENT DOCUMENTS

CN 104537985 A 4/2015

*Primary Examiner* — Patrick F Marinelli
(74) *Attorney, Agent, or Firm* — Leong C. Lei

(57) ABSTRACT

The present invention provides a method of compensating AMOLED IR Drop and a system. In the method of compensating AMOLED IR Drop, many times of iterated operations are performed to the power supply voltages and the driving currents of respective pixel driving circuits coupled in series on the same power supply line, and the adjustment and compensation are performed to the initial values Vdata1 to Vdatan of the data signal voltages for being inputted to respective pixel driving circuits according to the power supply voltages OVdd1 to OVddn of respective pixel driving circuits obtained with the last iterated operation of the calculation unit, and outputs the compensated data signal voltages Vdata1 to Vdatan corresponding to respective pixel driving circuits. The method can make that the driving currents flowing through respective pixels can be more uniform for solving the mura problem caused by IR Drop. The system of compensating AMOLED IR Drop can improve the brightness uniformity of an AMOLED display panel for solving the mura problem caused by IR Drop with setting the calculation unit, the storage unit, the compensation unit and the plurality of pixel driving circuits.

12 Claims, 10 Drawing Sheets

(56) References Cited

U.S. PATENT DOCUMENTS 8,199,075 B2 * 6/2012 Marx ..... G09G 3/3233 345/76
8,416,234 B2 * 4/2013 Mizukoshi ..... G09G 3/3233 345/214
8,427,405 B2 * 4/2013 Takasugi ..... G09G 3/3233 345/82
8,907,874 B2 * 12/2014 Taneda ..... G09G 3/3233 345/76
8,947,471 B2 * 2/2015 Oh ..... G09G 3/3258 345/690
9,019,187 B2 * 4/2015 Moon ..... G09G 3/3685 345/100
9,202,858 B2 * 12/2015 Taneda ..... G09G 3/3233
9,495,906 B2 * 11/2016 Ishii ..... G09G 3/3233
2006/0007202 A1 * 1/2006 Satoh ..... G09G 3/22 345/204
2006/0022969 A1 * 2/2006 Lee ..... G02F 1/136286 345/211
2006/0044237 A1 * 3/2006 Lee ..... G09G 3/3233 345/82
2008/0284688 A1 * 11/2008 Marx ..... G09G 3/3233 345/76
2009/0225072 A1 * 9/2009 Mizukoshi ..... G09G 3/3233 345/214
2010/0020065 A1 * 1/2010 Takasugi ..... G09G 3/3233 345/214
2012/0236041 A1 * 9/2012 Oh ..... G09G 3/3258 345/690
2012/0249514 A1 * 10/2012 Ahn ..... G09G 3/3233 345/212
2014/0062989 A1 * 3/2014 Ebisuno ..... G09G 3/3241 345/212
2014/0091996 A1 * 4/2014 Moon ..... G09G 3/3685 345/92
2014/0160179 A1 * 6/2014 Ishii ..... G09G 3/3233 345/690
2014/0218271 A1 * 8/2014 Taneda ..... G09G 3/3233 345/76
2015/0108459 A1 * 4/2015 Taneda ..... G09G 3/3233 257/40
2015/0200241 A1 * 7/2015 Kim ..... G09G 3/32 257/40
2016/0012768 A1 * 1/2016 In ..... G09G 3/3225 345/212
2016/0041638 A1 * 2/2016 Xie ..... G06F 3/041 345/173
2016/0078799 A1 * 3/2016 Taneda ..... G09G 3/3233 345/212
2016/0098958 A1 * 4/2016 Kang ..... G09G 3/3208 345/78
2016/0133188 A1 * 5/2016 Yin ..... G09G 3/3216 345/76
2016/0171929 A1 * 6/2016 Lee ..... G09G 3/3233 345/211
2016/0240140 A1 * 8/2016 Park ..... G09G 3/3208

* cited by examiner

| | | |
|---|---|---|
| 87. 9% | 89. 3% | 78. 9% |
| 89. 6% | 90. 0% | 81. 4% |
| 95. 3% | 100% | 87% |

step 1, providing an AMOLED display panel, comprising: a calculation unit, a storage unit, a compensation unit and a plurality of pixel driving circuits. The pixel driving circuit at least comprises two N-type thin film transistors, a capacitor (C) and an organic light emitting diode (OLED), wherein the N-type thin film transistor coupled to the organic light emitting diode (OLED) is a drive thin film transistor;

first, employing the storage unit to set power supply voltages of respective pixel driving circuits coupled in series on the same power supply line (L) to be a standard power supply voltage, which is set to be:

$$OVdd_1 = OVdd_2 = \ldots\ldots = OVdd_{n-1} = OVdd_n = OVdd \quad (1)$$

wherein OVdd1, OVdd2, OVddn-1, OVddn respectively represent the power supply voltages of the first, the second, the n-1th, the nth pixel driving circuits, and OVdd represents the standard power supply voltage;

1 step 2, the calculation unit reads the power supply voltages of respective pixel driving circuits from the storage unit, and calculates driving currents corresponding to the power supply voltages of respective pixel driving circuits, and the calculation equations are:

$$VGS_i = Vdata_i - (VS_i + \Delta VS_i) \quad (2)$$

$$VDS_i = OVdd_i - (VS_i + \Delta VS_i) \quad (3)$$

$$Ids_i = K \times (VGS_i - |Vth|)^2 \times (1 + \lambda \cdot VDS_i) \quad (4)$$

Idsi represents the driving current of the ith pixel driving circuit, and K represents a configuration parameter of the drive thin film transistor in respective pixel driving circuits, and VGSi represents a gate-source voltage of the drive thin film transistor in the ith pixel driving circuit, and Vth represents a threshold voltage of the drive thin film transistor in the respective pixel driving circuits, and λ represents a coefficient, and VDSi represents a source-drain voltage of the drive thin film transistor in the ith pixel driving circuit;

Vdatai represents an initial value of a data signal voltage preinputted to the ith pixel driving circuit, and VSi represents a source voltage of the drive thin film transistor in the ith pixel driving circuit, and Δ VSi represents a variation of VSi;

i=1, 2, ……n;

2 step 3, the calculation unit reversely obtains the power supply voltages OVdd1 to OVddn of respective pixel driving circuits according to the driving currents Ids1 to Idsn of respective pixel driving circuits calculated in the step 2; the calculation equation of the step 3 is:

$$OVdd_i = OVdd_{i-1} - (\Sigma_{i=n,\ i=i-1}^{1} Ids_i) \times R \quad (5)$$

wherein R is an equivalent resistance of the power supply line (L) between every two adjacent pixel driving circuits;

i=1, 2, ……n;

then, a first iterated operation is accomplished;

and then, the calculation unit stores the reversely obtained power supply voltages OVdd1 to OVddn of respective pixel driving circuits back to the storage unit;

3

Fig. 6A

METHOD OF COMPENSATING AMOLED IR DROP AND SYSTEM

FIELD OF THE INVENTION

The present invention relates to a display technology field, and more particularly to a method of compensating AMOLED IR Drop and a system.

BACKGROUND OF THE INVENTION

The Organic Light Emitting Display (OLED) possesses many outstanding properties of self-illumination, low driving voltage, high luminescence efficiency, short response time, high clarity and contrast, near 180° view angle, wide range of working temperature, applicability of flexible display and large scale full color display. The OLED is considered as the most potential display device.

The OLED can be categorized into two major types, which are the passive driving and the active driving, i.e. the direct addressing and the Thin Film Transistor (TFT) matrix addressing. The active driving is also called Active Matrix (AM) type. Each light-emitting element in the AMOLED is independently controlled by TFT addressing. The pixel structure comprising the light-emitting element and the TFT addressing circuit requires the conductive line to load the direct current output voltage (OVdd) for driving.

With the progress of time and technology, the large scale, high resolution AMOLED display device has been gradually developed. Correspondingly, the large scale AMOLED display device requires panel of larger scale and pixels of more amounts. The length of the conductive line becomes longer and longer, and the electrical resistance becomes larger. Unavoidably, the power supply voltage (OVdd) will generate the IR Drop on the conductive line. The electrical resistance value of the conductive line makes that the power supply voltage obtained by each pixel circuit is different. Thus, with the same input of the data signal voltage, different pixels have different currents, brightness outputs to result in that the display brightness of the entire panel is nonuniform, and image is different, and the IR drops of the pixels are thereupon different, either.

FIG. 1 is a structural diagram of a large scale OVDD single drive AMOLED display device. The AMOLED display device is an OVDD single drive type, and comprises a display panel 1, an OVdd line 2, X direction substrate (Xboard) 3, a Chip On Film (COF) end 4. Generally, the power supply voltage in the area close to the COF end 4, i.e. the OVDD power supplying position is higher than the power supply voltage in the area away from the power supplying position. FIG. 2 is a circuit diagram of 2T1C pixel driving circuit, comprising two N-type thin film transistors T10, T20 and a capacitor C10, which is the most common 2T1C structure. The first thin film transistor T10 is a switching thin film transistor, controlled by scan signal Gate, and employed to transmit data signal Data, and the second thin film transistor T20 is a driving thin film transistor, controlled by data signal Data, and employed to drive an organic light emitting diode OLED to emit light. The capacitor C10 is a storage capacitor. The pixel driving circuit of 2T1C structure can merely function to convert the voltage into the current to drive the organic light emitting diode to emit light without any compensation function.

FIG. 3 is a brightness distribution diagram of a 55 inches AMOLED display panel. At present, the image gray scale is 255. As shown in FIG. 3, the highest brightness of the display panel is 111.6, and the lowest brightness is 88.1 In combination with FIG. 4, the highest brightness 111.6 is set to be 100% brightness, and the brightnesses of the rest positions is converted into the percentage of the highest brightness when the highest brightness is considered as the base, the lowest brightness is only 78.9%. Obviously, the brightness uniformity of the AMOLED display panel is worse. Furthermore, please refer to FIG. 5. FIG. 5 is a circuit diagram of one pixel driving circuit in the AMOLED display panel shown in FIG. 3, which comprises three N-type thin film transistors T10, T20, T30 and a capacitor C10. i.e. the 3T1C structure, wherein the first thin film transistor T10 remains to be a switching thin film transistor, and the second thin film transistor T20 remains to be a driving thin film transistor, and the additional third thin film transistor T30 receives an external signal line (monitor line), and the capacitor C10 is a storage capacitor. The pixel driving circuit of the 3T1C structure can compensate the threshold voltages of the organic light emitting diode OLED and the driving thin film transistor T20 but cannot compensate the IR Drop. Therefore, the brightness uniformity of the AMOLED display panel still remains to be worse.

In the pixel driving circuit of the 3T1C structure shown in FIG. 5, the electric compensation in the AMOLED external compensation method is utilized, which only can compensate the threshold voltages of driving the TFT and OLED but cannot compensate IR Drop; besides, the AMOLED external compensation method also comprises the optical compensation, and the optical compensation can compensate IR Drop but cannot achieve the compensation in real time. On the contrary, the AMOLED compensation method can further include the internal compensation. The internal compensation of the AMOLED is to compensate the threshold voltage (Vth) of the TFT or the channel mobility (μ) but rarely to compensate the IR drop. If the internal compensation is to compensate the IR Drop, many TFTs and capacitors have to be additionally set. The aperture ratio will be sacrificed and the necessary control signals are more.

SUMMARY OF THE INVENTION

An objective of the present invention is to provide a method of compensating AMOLED IR Drop, capable of improving the brightness uniformity of an AMOLED display panel for solving the mura problem caused by IR Drop.

Another objective of the present invention is to provide a system of compensating AMOLED IR Drop, capable of improving the brightness uniformity of an AMOLED display panel for solving the mura problem caused by IR Drop.

For realizing the aforesaid objectives, the present invention provides a method of compensating AMOLED IR Drop, comprising steps of:

step 1, providing an AMOLED display panel, comprising: a calculation unit, a storage unit, a compensation unit and a plurality of pixel driving circuits; the pixel driving circuit at least comprises two N-type thin film transistors, a capacitor and an organic light emitting diode, wherein the N-type thin film transistor coupled to the organic light emitting diode is a drive thin film transistor;

first, employing the storage unit to set power supply voltages of respective pixel driving circuits coupled in series on the same power supply line to be a standard power supply voltage, which is set to be:

$$OVdd_1=OVdd_2=\ldots=OVdd_{n-1}=OVdd_n=OVdd \quad (1)$$

wherein OVdd1, OVdd2, OVddn−1, OVddn respectively represent the power supply voltages of the first, the second, the n−1th, the nth pixel driving circuits, OVdd represents the standard power supply voltage;

step2, the calculation unit reads the power supply voltages of respective pixel driving circuits from the storage unit, and calculates driving currents corresponding to the power supply voltages of respective pixel driving circuits, and the calculation equationsare:

$$VGS_i = \text{Vdata}_i - (VS_i + \Delta VS_i) \quad (2)$$

$$VDS_i = OVdd_i - (VS_i + \Delta VS_i) \quad (3)$$

$$Ids_i = K \times (VGS_i - |Vth|)^2 \times (1 + \lambda \cdot VDS_i) \quad (4)$$

Idsi represents the driving current of the ith pixel driving circuit, and K represents a configuration parameter of the drive thin film transistor in respective pixel driving circuits, and VGSi represents a gate-source voltage of the drive thin film transistor in the ith pixel driving circuit, and Vth represents a threshold voltage of the drive thin film transistor in the respective pixel driving circuits, and A represents a coefficient, and VDSi represents a source-drain voltage of the drive thin film transistor in the ith pixel driving circuit;

Vdatai represents an initial value of a data signal voltage preinputted to the ith pixel driving circuit, and VSi represents a source voltage of the drive thin film transistor in the ith pixel driving circuit, and ΔVSi represents a variation of VSi;

i=1, 2, . . . n;

step 3, the calculation unit reversely obtains the power supply voltages OVdd1 to OVddn of respective pixel driving circuits according to the driving currents Ids1 to Idsn of respective pixel driving circuits calculated in the step 2, and the calculation equation is:

$$OVdd_i = OVdd_{i-1} - (\Sigma_{i=n,i=i-1}{}^{i} Ids_i) \times R \quad (5)$$

wherein R is an equivalent resistance of the power supply line between every two adjacent pixel driving circuits;

i=1, 2, . . . n;

then, a first iterated operation is accomplished;

then, the calculation unit stores the reversely obtained power supply voltages OVdd1 to OVddn of respective pixel driving circuits back to the storage unit;

step 4, the calculation unit calculates and compares whether a ratio of the difference ΔOVddi of the power supply voltages OVddi−1 and OVddi of every two adjacent pixel driving circuits which are reversely obtained in the step 3, and the power supply voltage OVddi of the ith pixel driving circuit reaches a requirement of being smaller than a specific design value, if the ratio reached, and then the power supply voltages OVdd1 to OVddn of respective pixel driving circuits are fed to the compensation unit, and then implementing the following step 5, and if not, then returning back to the step 2 and the step 3 and an iterated operation is continued to OVdd1 to OVddn;

step 5, the compensation unit performs adjustment and compensation to the initial values Vdata1 to Vdatan of the data signal voltages for being inputted to respective pixel driving circuits according to the power supply voltages OVdd1 to OVddn of respective pixel driving circuits obtained with the last iterated operation of the calculation unit, and outputs the compensated data signal voltages Vdata1 to Vdatan corresponding to respective pixel driving circuits.

In the step 2, the source voltage VSi of the drive thin film transistor in the ith pixel driving circuit is a function of Vdatai, and with analog simulation; the calculation equations of a variation ΔVSi of VSi are:

$$\Delta VS_i = \Delta OVdd_i \times \frac{r_{OLED}}{r_{OLED} + r_o} \quad (6)$$

$$\text{wherein, } \Delta OVdd_i = OVdd_{i-1} - OVdd_i = (\Sigma_{i=n,i=i-1}{}^{i} Ids_i) \times R \quad (7)$$

rOLED represents an equivalent resistance of the organic light emitting diodes (OLED) in respective pixel driving circuits, and ro represents an equivalent resistance between the source and the drain of the driving thin film transistors in respective pixel driving circuits, which is a constant;

i=1, 2, . . . n.

The method of compensating AMOLED power supply voltage drop is applied to an OVDD single drive AMOLED display device or an OVDD double drive AMOLED display device.

In the step 5, the compensation values for the initial values Vdata1 to Vdatan of the data signal voltages for being inputted to respective pixel driving circuits respectively are differences between the power supply voltages OVdd1 to OVddn of respective pixel driving circuits obtained with the last iterated operation of the calculation unit and the standard power supply voltage OVdd.

The pixel driving circuit comprises a switching thin film transistor, the driving thin film transistor and the capacitor, and a gate of the switching thin film transistor is electrically coupled to a scan signal, and a source is electrically coupled to a data signal after compensation, and a drain is electrically coupled to a gate of the driving thin film transistor and one end of the capacitor; a drain of the driving thin film transistor is electrically coupled to the power supply line, and a source is electrically coupled to an anode of the organic light emitting diode; a cathode of the organic light emitting diode is electrically coupled to a power supply low voltage level; the one end of the capacitor is electrically coupled to the drain of the switching thin film transistor and the other end is electrically coupled to the drain of the driving thin film transistor.

The present invention further provides a system of compensating AMOLED IR Drop, comprising: a calculation unit, a storage unit, a compensation unit and a plurality of pixel driving circuits; the pixel driving circuit at least comprises two N-type thin film transistors, a capacitor and an organic light emitting diode, wherein the N-type thin film transistor coupled to the organic light emitting diode is a drive thin film transistor;

the storage unit is employed to set power supply voltages of respective pixel driving circuits coupled in series on the same power supply line to be a standard power supply voltage and stores the power supply voltages of respective pixel driving circuits calculated by the calculation unit with an iterated operation;

the calculation unit is employed to read the power supply voltages of respective pixel driving circuits from the storage unit, and calculate driving currents corresponding to the power supply voltages of respective pixel driving circuits, and reversely obtain the power supply voltages of respective pixel driving circuits according to the calculated driving currents of respective pixel driving circuits, and then store the reversely obtained power supply voltages of respective pixel driving circuits back to the storage unit; after many time iterated operations of the calculation unit, a ratio of the difference ΔOVddi of the power supply voltages OVddi−1 and OVddi of every two adjacent pixel driving circuits which are reversely obtained, and the power supply voltage OVddi of the ith pixel driving circuit reaches a requirement of being smaller than a specific design value, wherein i=1, 2, . . . n;

the compensation unit performs adjustment and compensation to the initial values Vdata1 to Vdatan of the data signal voltages for being inputted to respective pixel driving circuits according to the power supply voltages OVdd1 to OVddn of respective pixel driving circuits obtained with the last iterated operation of the calculation unit, and outputs the compensated data signal voltages Vdata1 to Vdatan corresponding to respective pixel driving circuits;

the pixel driving circuits receives the compensated data signal voltages Vdata1 to Vdatan from the compensation unit to drive the organic light emitting diode to emit light.

The calculation equations that the calculation unit calculates driving currents corresponding to the power supply voltages of respective pixel driving circuits are:

$$VGS_i = V\text{data}_i - (VS_i + \Delta VS_i) \tag{2}$$

$$VDS_i = OVdd_i - (VS_i + \Delta VS) \tag{3}$$

$$Ids_i = K \times (VGS_i - |Vth|)^2 \times (1 + \lambda \cdot VDS) \tag{4}$$

OVddi represents power supply voltage of the ith pixel driving circuit, and Idsi represents the driving current of the ith pixel driving circuit, and K represents a configuration parameter of the drive thin film transistor in respective pixel driving circuits, and VGSi represents a gate-source voltage of the drive thin film transistor in the ith pixel driving circuit, and Vth represents a threshold voltage of the drive thin film transistor in the respective pixel driving circuits, and A represents a coefficient, and VDSi represents a source-drain voltage of the drive thin film transistor in the ith pixel driving circuit;

Vdatai represents an initial value of a data signal voltage preinputted to the ith pixel driving circuit, and VSi represents a source voltage of the drive thin film transistor in the ith pixel driving circuit, and ΔVSi represents a variation of VSi;

the calculation equation that the calculation unit reversely obtains the power supply voltages of respective pixel driving circuits according to the calculated driving currents is:

$$OVdd_i = OVdd_{i-1}(\Sigma_{i=n,i=i-1}{}^{i}Ids_i) \times R \tag{5}$$

wherein R is an equivalent resistance of the power supply line between every two adjacent pixel driving circuits;

i=1, 2, . . . n.

The source voltage VSi of the drive thin film transistor in the ith pixel driving circuit is a function of Vdatai, and with analog simulation; the calculation equations of a variation ΔVSi of VSi are:

$$\Delta VS_i = \Delta OVdd_i \times \frac{r_{OLED}}{r_{OLED} + r_o} \tag{6}$$

$$\text{wherein, } \Delta OVdd_i = OVdd_{i-1} - OVdd_i = (\Sigma_{i=n,i=i-1}{}^{i}Ids_i) \times R \tag{7}$$

rOLED represents an equivalent resistance of the organic light emitting diodes in respective pixel driving circuits, and ro represents an equivalent resistance between the source and the drain of the driving thin film transistors in respective pixel driving circuits, which is a constant;

i=1, 2, . . . n.

The compensation values for the initial values Vdata1 to Vdatan of the data signal voltages for being inputted to respective pixel driving circuits respectively are differences between the power supply voltages OVdd1 to OVddn of respective pixel driving circuits obtained with the last iterated operation of the calculation unit and the standard power supply voltage.

The pixel driving circuit comprises a switching thin film transistor, the driving thin film transistor and the capacitor, and a gate of the switching thin film transistor is electrically coupled to a scan signal, and a source is electrically coupled to a data signal after compensation, and a drain is electrically coupled to a gate of the driving thin film transistor and one end of the capacitor; a drain of the driving thin film transistor is electrically coupled to the power supply line, and a source is electrically coupled to an anode of the organic light emitting diode; a cathode of the organic light emitting diode is electrically coupled to a power supply low voltage level; the one end of the capacitor is electrically coupled to the drain of the switching thin film transistor and the other end is electrically coupled to the drain of the driving thin film transistor.

The present invention further provides a system of compensating AMOLED IR Drop, comprising: a calculation unit, a storage unit, a compensation unit and a plurality of pixel driving circuits; the pixel driving circuit at least comprises two N-type thin film transistors, a capacitor and an organic light emitting diode, wherein the N-type thin film transistor coupled to the organic light emitting diode is a drive thin film transistor;

the storage unit is employed to set power supply voltages of respective pixel driving circuits coupled in series on the same power supply line to be a standard power supply voltage and stores the power supply voltages of respective pixel driving circuits calculated by the calculation unit with an iterated operation;

the calculation unit is employed to read the power supply voltages of respective pixel driving circuits from the storage unit, and calculate driving currents corresponding to the power supply voltages of respective pixel driving circuits, and reversely obtain the power supply voltages of respective pixel driving circuits according to the calculated driving currents of respective pixel driving circuits, and then store the reversely obtained power supply voltages of respective pixel driving circuits back to the storage unit; after many time iterated operations of the calculation unit, a ratio of the difference ΔOVddi of the power supply voltages OVddi−1 and OVddi of every two adjacent pixel driving circuits which are reversely obtained, and the power supply voltage OVddi of the ith pixel driving circuit reaches a requirement of being smaller than a specific design value, wherein i=1, 2, . . . n;

the compensation unit performs adjustment and compensation to the initial values Vdata1 to Vdatan of the data signal voltages for being inputted to respective pixel driving circuits according to the power supply voltages OVdd1 to OVddn of respective pixel driving circuits obtained with the last iterated operation of the calculation unit, and outputs the compensated data signal voltages Vdata1 to Vdatan corresponding to respective pixel driving circuits;

the pixel driving circuits receives the compensated data signal voltages Vdata1 to Vdatan from the compensation unit to drive the organic light emitting diode to emit light;

wherein the calculation equations that the calculation unit calculates driving currents corresponding to the power supply voltages of respective pixel driving circuits are:

$$VGS_i = V\text{data}_i - (VS_i + \Delta VS_i) \tag{2}$$

$$VDS_i = OVdd_i - (VS_i + \Delta VS_i) \tag{3}$$

$$Ids_i = K \times (VGS_i - |Vth|^2 \times (1 + \lambda \cdot VDS) \quad (4)$$

OVddi represents power supply voltage of the ith pixel driving circuit, and Idsi represents the driving current of the ith pixel driving circuit, and K represents a configuration parameter of the drive thin film transistor in respective pixel driving circuits, and VGSi represents a gate-source voltage of the drive thin film transistor in the ith pixel driving circuit, and Vth represents a threshold voltage of the drive thin film transistor in the respective pixel driving circuits, and λ represents a coefficient, and VDSi represents a source-drain voltage of the drive thin film transistor in the ith pixel driving circuit;

Vdatai represents an initial value of a data signal voltage preinputted to the ith pixel driving circuit, and VSi represents a source voltage of the drive thin film transistor in the ith pixel driving circuit, and ΔVSi represents a variation of VSi;

the calculation equation that the calculation unit reversely obtains the power supply voltages of respective pixel driving circuits according to the calculated driving currents is:

$$OVdd_i = OVdd_{i-1} - (\Sigma_{i=n,i=i-1}{}^{i} Ids_i) \times R \quad (5)$$

wherein R is an equivalent resistance of the power supply line between every two adjacent pixel driving circuits;

i=1, 2, . . . n.

wherein the compensation values for the initial values Vdata1 to Vdatan of the data signal voltages for being inputted to respective pixel driving circuits respectively are differences between the power supply voltages OVdd1 to OVddn of respective pixel driving circuits obtained with the last iterated operation of the calculation unit and the standard power supply voltage;

wherein the pixel driving circuit comprises a switching thin film transistor, the driving thin film transistor and the capacitor, and a gate of the switching thin film transistor is electrically coupled to a scan signal, and a source is electrically coupled to a data signal after compensation, and a drain is electrically coupled to a gate of the driving thin film transistor and one end of the capacitor; a drain of the driving thin film transistor is electrically coupled to the power supply line, and a source is electrically coupled to an anode of the organic light emitting diode; a cathode of the organic light emitting diode is electrically coupled to a power supply low voltage level; the one end of the capacitor is electrically coupled to the drain of the switching thin film transistor and the other end is electrically coupled to the drain of the driving thin film transistor.

The benefits of the present invention are: in the method of compensating AMOLED IR Drop according to the present invention, many times of iterated operations are performed to the power supply voltages and the driving currents of respective pixel driving circuits coupled in series on the same power supply line, and the adjustment and compensation are performed to the initial values Vdata1 to Vdatan of the data signal voltages for being inputted to respective pixel driving circuits according to the power supply voltages OVdd1 to OVddn of respective pixel driving circuits obtained with the last iterated operation of the calculation unit, and outputs the compensated data signal voltages Vdata1 to Vdatan corresponding to respective pixel driving circuits. The method can make that the driving currents flowing through respective pixels can be more uniform for improving the brightness uniformity of an AMOLED display panel for solving the mura problem caused by IR Drop. The system of compensating AMOLED IR Drop provided by the present invention can improve the brightness uniformity of an AMOLED display panel for solving the mura problem caused by IR Drop with setting the calculation unit, the storage unit, the compensation unit and the plurality of pixel driving circuits.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings,

FIGS. 6A and 6B collectively illustrates a flowchart of a method of compensating AMOLED IR Drop according to the present invention, in which FIG. 6A illustrates the first three step of the method and FIG. 6B illustrates the remaining steps of the method;

DETAILED DESCRIPTION OF PREFERRED EMBODIMENTS

For better explaining the technical solution and the effect of the present invention, the present invention will be further described in detail with the accompanying drawings and the specific embodiments.

Figure 6B:
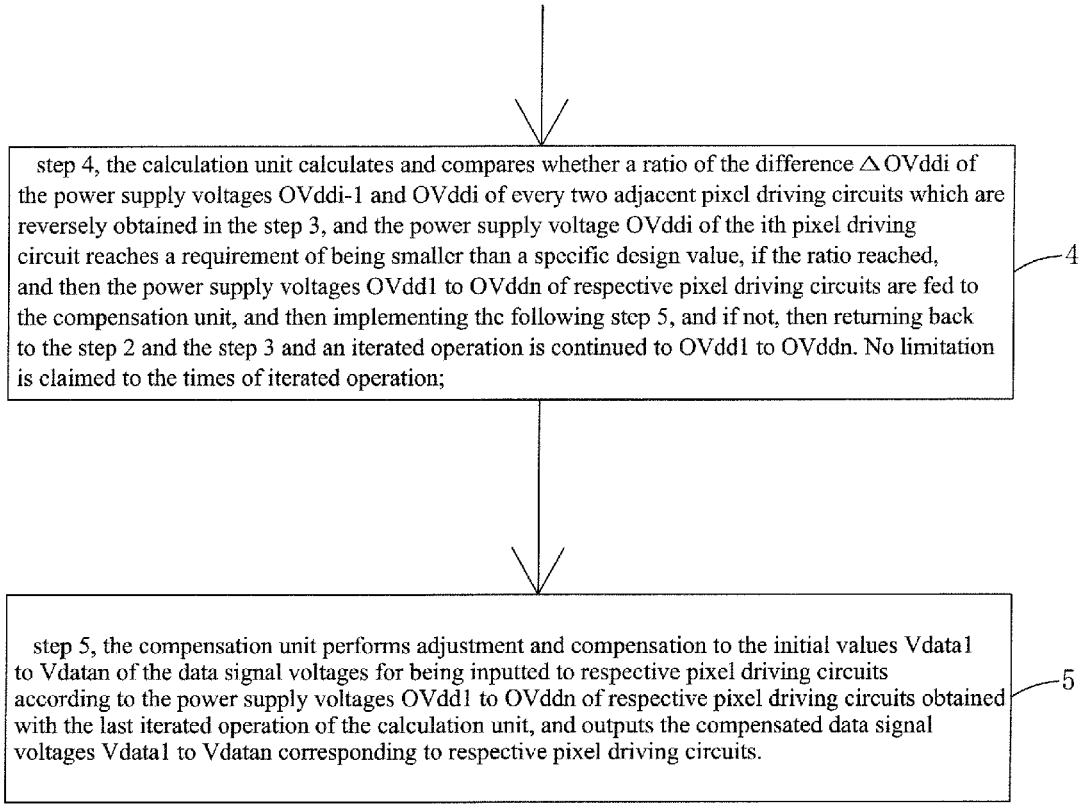
Figure 7:
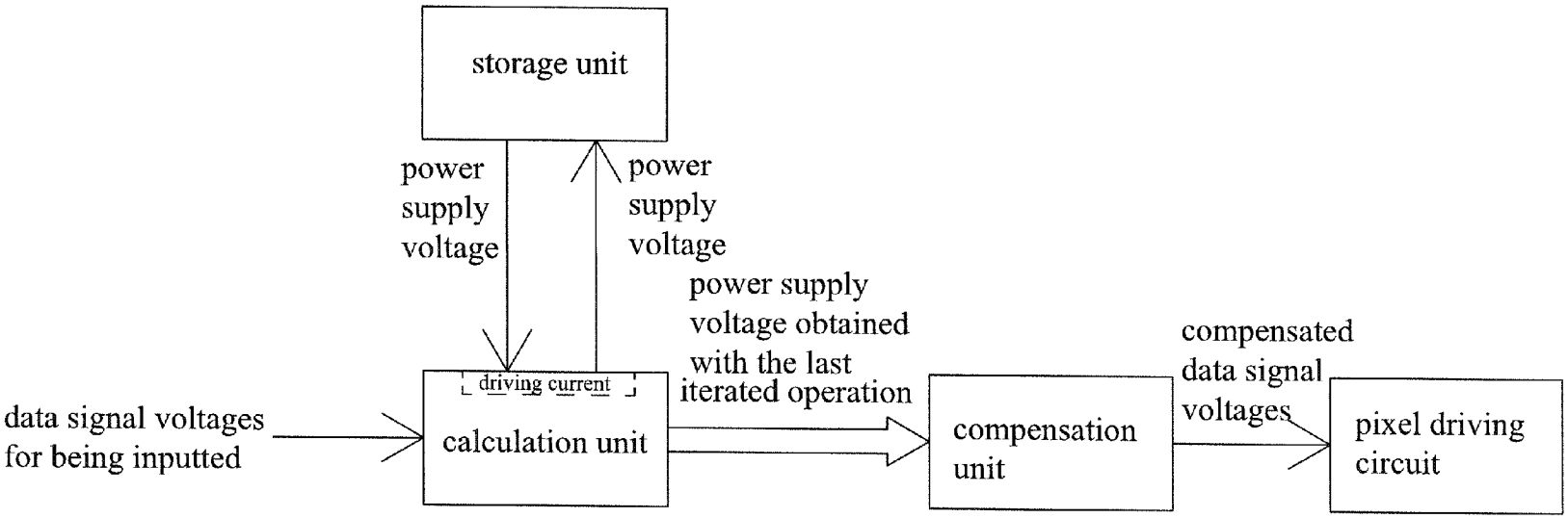
FIG. 7 is a structural diagram of a system of compensating AMOLED IR Drop according to the present invention.
Figure 8:
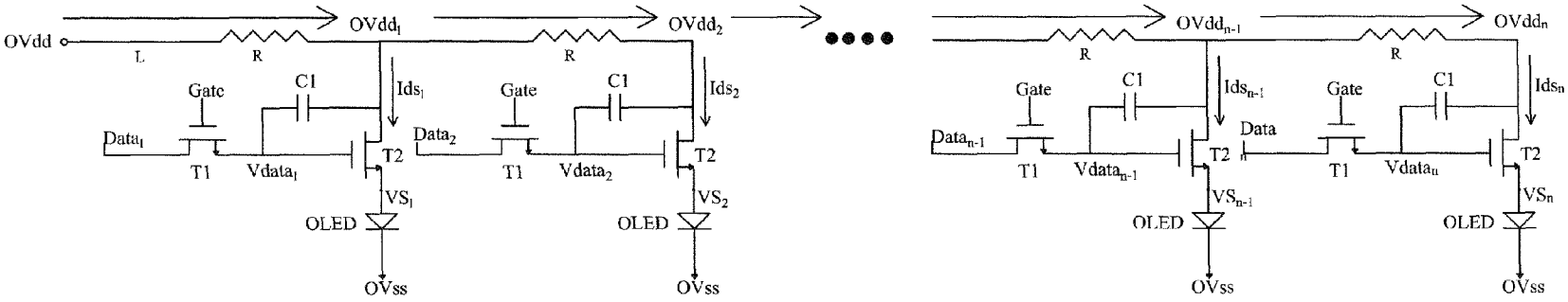
FIG. 8 is a circuit diagram of a plurality of pixel driving circuits coupled in series on the same power supply line in the system of compensating AMOLED IR Drop according to the present invention.

Please refer to FIG. 6. The present invention first provides a method of compensating AMOLED IR Drop, comprising steps of:

step 1, providing an AMOLED display panel, as shown in FIG. 7, FIG. 8, comprising: a calculation unit, a storage unit, a compensation unit and a plurality of pixel driving circuits. The pixel driving circuit at least comprises two N-type thin film transistors, a capacitor and an organic light emitting diode, wherein the N-type thin film transistor coupled to the organic light emitting diode is a drive thin film transistor.

First, employing the storage unit to set power supply voltages of respective pixel driving circuits coupled in series on the same power supply line to be a standard power supply voltage, which is set to be:

$$OVdd_1=OVdd_2=\ldots=OVdd_{n-1}=OVdd_n=OVdd \quad (1)$$

wherein OVdd1, OVdd2, $OVdd_{n-1}$, OVddn respectively represent the power supply voltages of the first, the second, the n−1th, the nth pixel driving circuits, and OVdd represents the standard power supply voltage, and n is an integer larger than 1. As shown in FIG. 8, the first pixel driving circuit to the nth pixel driving circuit are coupled in series on a power supply line L. The first pixel driving circuit is the closest one to the standard power supply voltage OVdd, and the nth pixel driving circuit is the furthest one to the standard power supply voltage OVdd.

Figure 9:
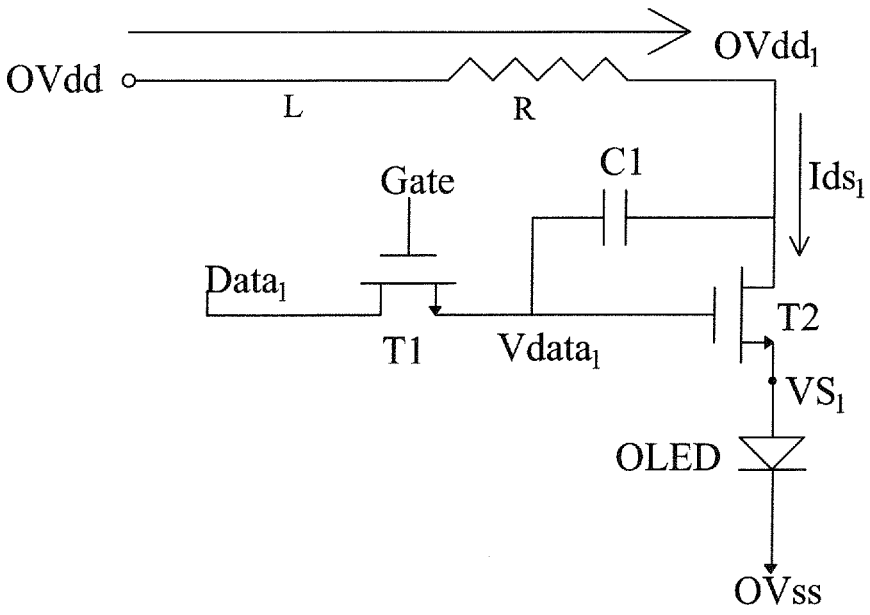
FIG. 9 is a circuit diagram of a first pixel driving circuit.

Specifically, the pixel driving circuit can be but not limited to the 2T1C structure. The pixel driving circuit shown in FIG. 8, FIG. 9 is illustrated, which comprises a switching thin film transistor T1, a driving thin film transistor T2 and a capacitor C, and a gate of the switching thin film transistor T1 is electrically coupled to a scan signal Gate, and a source is electrically coupled to a data signal Data, and a drain is electrically coupled to a gate of the driving thin film transistor T2 and one end of the capacitor C; a drain of the driving thin film transistor T2 is electrically coupled to the power supply line L, and a source is electrically coupled to an anode of the organic light emitting diode D; a cathode of the organic light emitting diode D is electrically coupled to a power supply low voltage level OVss; the one end of the capacitor C is electrically coupled to the drain of the switching thin film transistor T1 and the other end is electrically coupled to the drain of the driving thin film transistor T2.

step2, the calculation unit reads the power supply voltages of respective pixel driving circuits from the storage unit, and calculates driving currents corresponding to the power supply voltages of respective pixel driving circuits, and the calculation equationsare:

$$VGS_i=\mathrm{Vdata}_i-(VS_i+\Delta VS_i) \quad (2)$$

$$VDS_i=OVdd_i-(VS_i+\Delta VS_i) \quad (3)$$

$$Ids_i=K\times(VGS_i-|Vth|)^2\times(1+\lambda\cdot VDS) \quad (4)$$

Idsi represents the driving current of the ith pixel driving circuit, and K represents a configuration parameter of the drive thin film transistor in respective pixel driving circuits, and VGSi represents a gate-source voltage of the drive thin film transistor in the ith pixel driving circuit, and Vth represents a threshold voltage of the drive thin film transistor in the respective pixel driving circuits, and λ represents a coefficient, and VDSi represents a source-drain voltage of the drive thin film transistor in the ith pixel driving circuit;

Vdatai represents an initial value of a data signal voltage preinputted to the ith pixel driving circuit, and VSi represents a source voltage of the drive thin film transistor in the ith pixel driving circuit, and ΔVSi represents a variation of VSi;

i=1, 2, . . . n.

Furthermore, in the step 2, the source voltage VSi of the drive thin film transistor in the ith pixel driving circuit is a function of Vdatai, and with analog simulation; the calculation equations of a variation ΔVSi of VSi are:

$$\Delta VS_i=\Delta OVdd_i\times\frac{r_{OLED}}{r_{OLED}+r_o} \quad (6)$$

$$\text{wherein, } \Delta OVdd_i=OVdd_{i-1}-OVdd_i=(\Sigma_{i=n,i=1-1}{}^{i}Ids_i)\times R \quad (7)$$

R is an equivalent resistance of the power supply line between every two adjacent pixel driving circuits, and rOLED represents an equivalent resistance of the organic light emitting diodes in respective pixel driving circuits, and ro represents an equivalent resistance between the source and the drain of the driving thin film transistors in respective pixel driving circuits, which is a constant.

Figure 10:
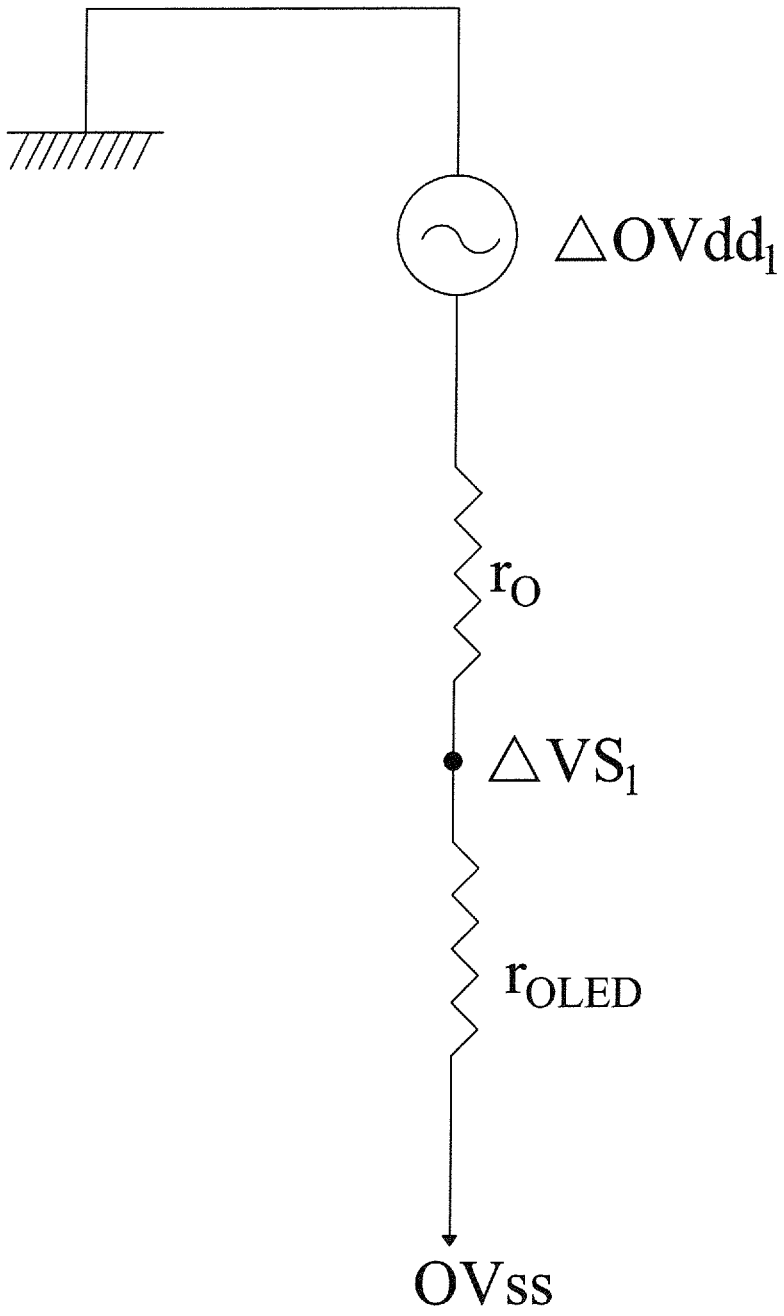
FIG. 10 is an equivalent circuit diagram corresponding to the driving thin film transistor and the organic light emitting diode in FIG. 9.

The first pixel driving circuit shown in FIG. 9, FIG. 10 is illustrated, and the calculations of the variation ΔVS1 of VS1 are:

$$\Delta OVdd_1=OVdd-OVdd_1=Ids_1\times R$$

$$\Delta VS_1=\Delta OVdd_1\times\frac{r_{OLED}}{r_{OLED}+r_o}$$

step 3, the calculation unit reversely obtains the power supply voltages OVdd1 to OVddn of respective pixel driving circuits according to the driving currents Ids1 to Idsn of respective pixel driving circuits calculated in the step 2.

As shown in FIG. 8, in the first to nth pixel driving circuits:

$$OVdd_n=OVdd_{n-1}-Ids_n\times R$$

$$OVdd_{n-1}=OVdd_{n-2}-(Ids_n+Ids_{n-1})\times R$$

$$\vdots$$

$$OVdd_2=OVdd_1-(Ids_n+Ids_{n-1}+\ldots+Ids_3+Ids_2)\times R$$

$$OVdd_1=OVdd-(Ids_n+Ids_{n-1}+\ldots+Ids_2+Ids_1)\times R$$

the calculation equation of the step 3 is:

$$OVdd_i=OVdd_{i-1}-(\Sigma_{i=n,i=i-1}{}^{i}Ids_i)\times R$$

wherein R is an equivalent resistance of the power supply line between every two adjacent pixel driving circuits;

i=1, 2, . . . n;

then, a first iterated operation is accomplished;

and then, the calculation unit stores the reversely obtained power supply voltages OVdd1 to OVddn of respective pixel driving circuits back to the storage unit;

step 4, the calculation unit calculates and compares whether a ratio of the difference ΔOVddi of the power supply voltages OVddi-1 and OVddi of every two adjacent pixel driving circuits which are reversely obtained in the step 3, and the power supply voltage OVddi of the ith pixel driving circuit reaches a requirement of being smaller than a specific design value, if the ratio reached, and then the power supply voltages OVdd1 to OVddn of respective pixel driving circuits are fed to the compensation unit, and then implementing the following step 5, and if not, then returning back to the step 2 and the step 3 and an iterated operation is continued to OVdd1 to OVddn. No limitation is claimed to the times of iterated operation.

step 5, the compensation unit performs adjustment and compensation to the initial values Vdata1 to Vdatan of the data signal voltages for being inputted to respective pixel driving circuits according to the power supply voltages OVdd1 to OVddn of respective pixel driving circuits obtained with the last iterated operation of the calculation unit, and outputs the compensated data signal voltages Vdata1 to Vdatan corresponding to respective pixel driving circuits.

Specifically, in the step 5, the compensation values for the initial values Vdata1 to Vdatan of the data signal voltages for being inputted to respective pixel driving circuits respectively are differences between the power supply voltages OVdd1 to OVddn of respective pixel driving circuits obtained with the last iterated operation of the calculation unit and the standard power supply voltage OVdd.

After the step 5 is accomplished, the pixel driving circuits receives the compensated data signal voltages Vdata1 to Vdatan from the compensation unit to drive the organic light emitting diode OLED to emit light to make that the driving currents flowing through respective pixels can be more uniform for improving the brightness uniformity of an AMOLED display panel for solving the mura problem caused by IR Drop.

Figure 1:
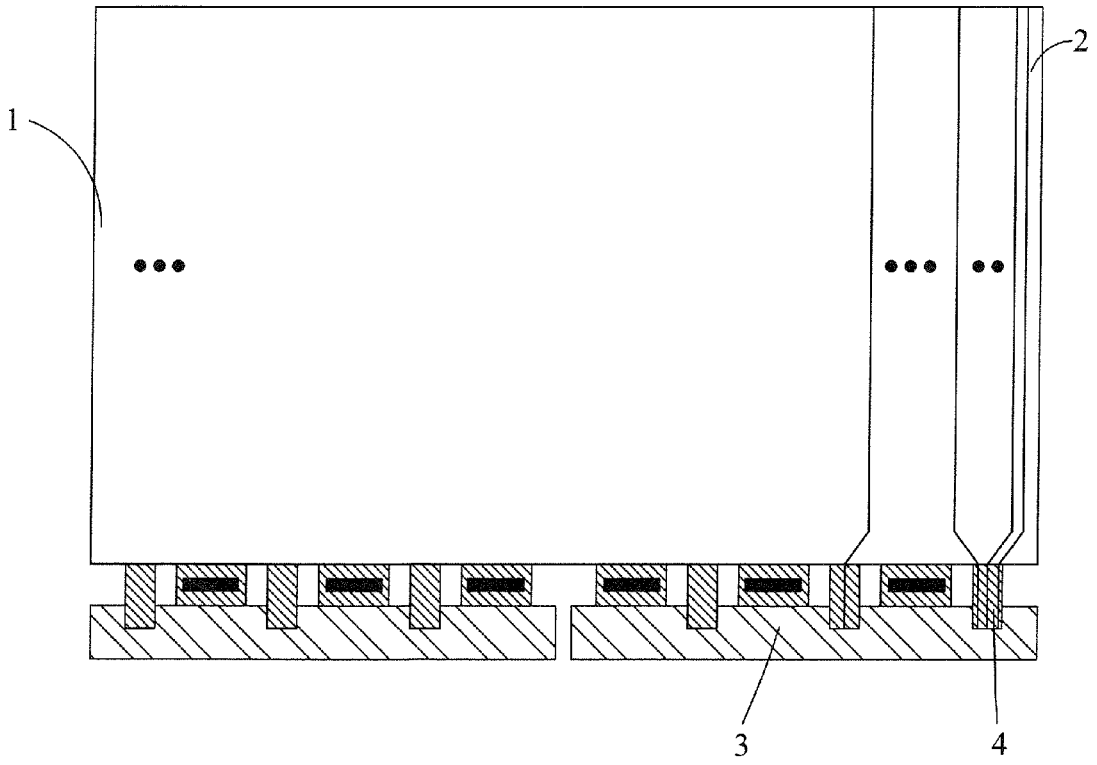
FIG. 1 is a structural diagram of a large scale OVDD single drive AMOLED display device.
Figure 2:
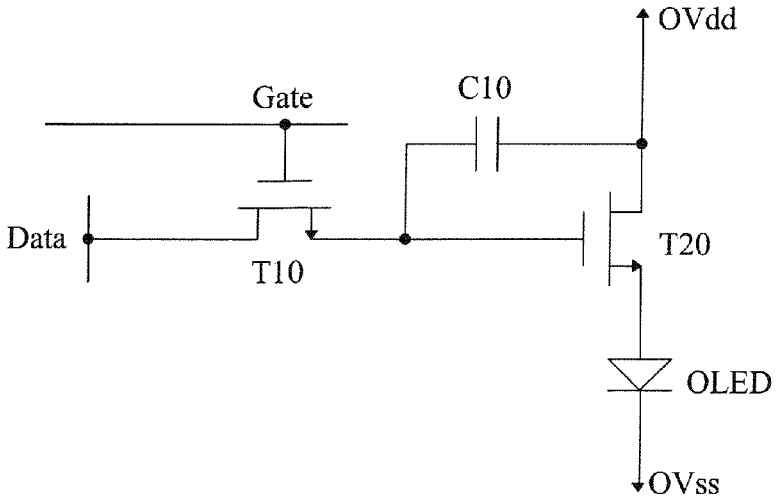
FIG. 2 is a circuit diagram of 2T1C pixel driving circuit.
Figure 3:
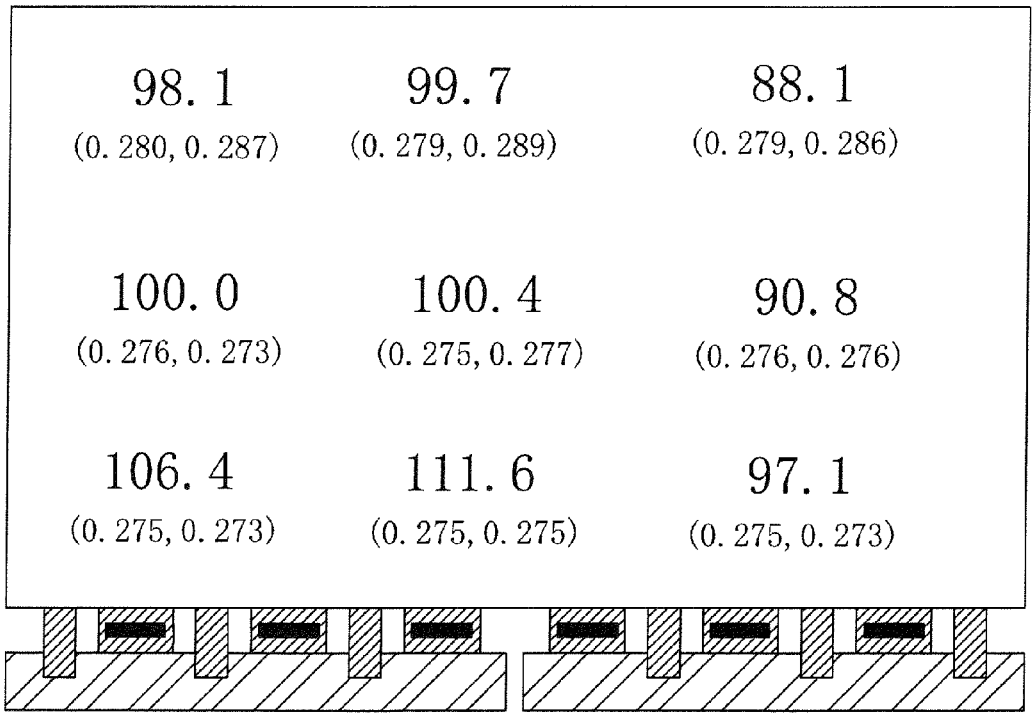
FIG. 3 is a brightness distribution diagram of a 55 inches AMOLED display panel.
Figures 4, 5:
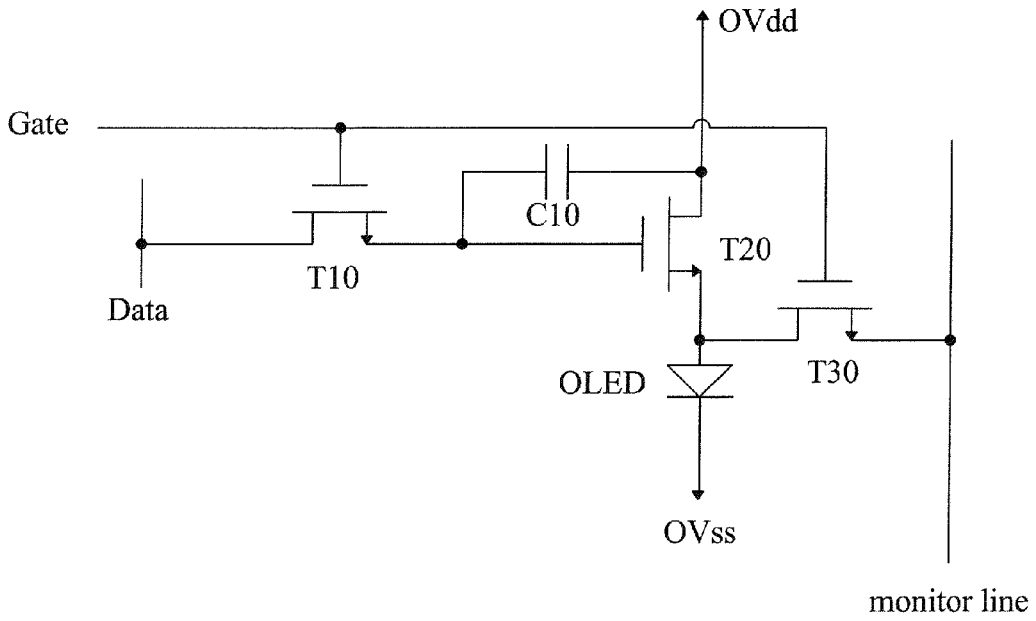
FIG. 4 is a percentage diagram of the brightness distribution diagram shown in FIG. 3.
FIG. 5 is a circuit diagram of one pixel driving circuit in the AMOLED display panel shown in FIG. 3.
Figure 11:
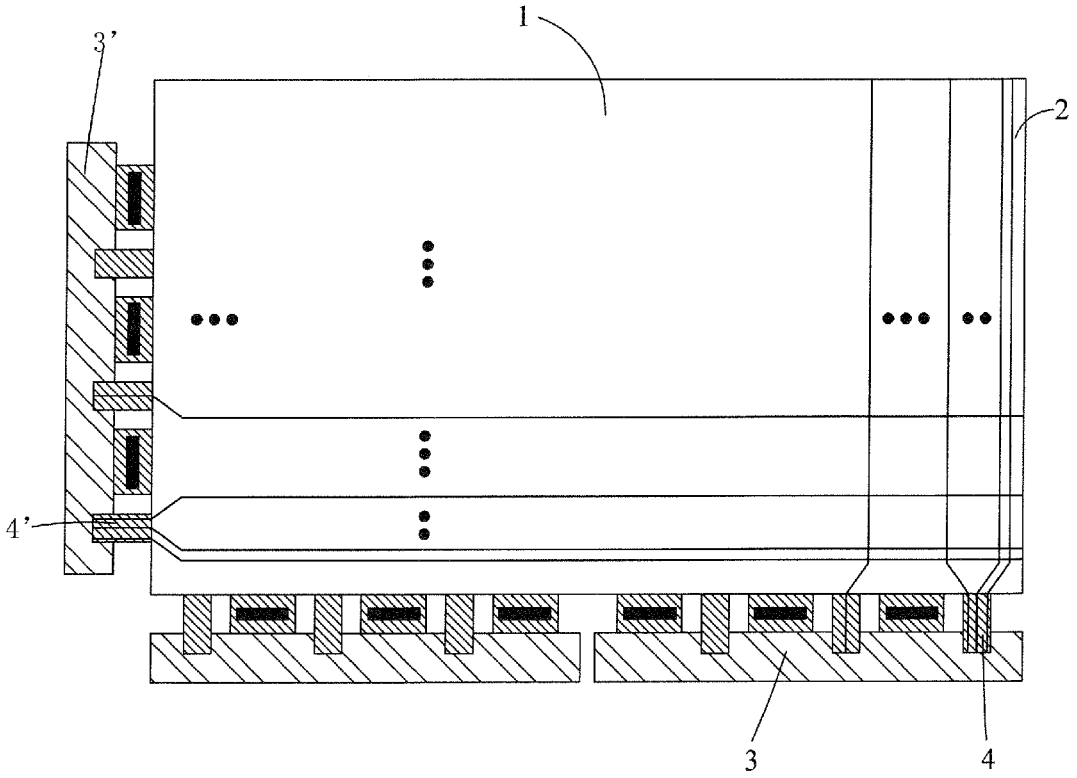
FIG. 11 is a structural diagram of an OVDD double drive AMOLED display device applied with the method of compensating AMOLED IR Drop according to the present invention.

The aforesaid method of compensating AMOLED IR drop can be applied in the OVDD single drive AMOLED display device shown in FIG. 1, and can be applied in the OVDD double drive AMOLED display device shown in FIG. 11. The OVDD double drive AMOLED display device shown in FIG. 11 is added with a second X direction substrate 3' and a second COF end 4'. As utilizing the method of compensating AMOLED IR drop, the compensation results of the two drivings can be overlapped.

Please refer from FIG. 7 to FIG. 10. The present invention further provides a system of compensating AMOLED IR Drop, comprising: a calculation unit, a storage unit, a compensation unit and a plurality of pixel driving circuits; the pixel driving circuit at least comprises two N-type thin film transistors, a capacitor C and an organic light emitting diode OLED, wherein the N-type thin film transistor coupled to the organic light emitting diode OLED is a drive thin film transistor. The calculation unit is electrically coupled to the data signal input end, the storage unit and the compensation unit; the storage unit is electrically coupled to the calculation unit; the compensation unit is electrically coupled to the calculation unit and the pixel driving circuit.

The storage unit is employed to set power supply voltages of respective pixel driving circuits coupled in series on the same power supply line to be a standard power supply voltage and stores the power supply voltages of respective pixel driving circuits calculated by the calculation unit with an iterated operation.

The calculation unit is employed to read the power supply voltages of respective pixel driving circuits from the storage unit, and calculate driving currents corresponding to the power supply voltages of respective pixel driving circuits, and reversely obtain the power supply voltages of respective pixel driving circuits according to the calculated driving currents of respective pixel driving circuits, and then store the reversely obtained power supply voltages of respective pixel driving circuits back to the storage unit; after many time iterated operations of the calculation unit, a ratio of the difference ΔOVddi of the power supply voltages OVddi-1 and OVddi of every two adjacent pixel driving circuits which are reversely obtained, and the power supply voltage OVddi of the ith pixel driving circuit reaches a requirement of being smaller than a specific design value, wherein i=1, 2, . . . n.

The compensation unit performs adjustment and compensation to the initial values Vdata1 to Vdatan of the data signal voltages for being inputted to respective pixel driving circuits according to the power supply voltages OVdd1 to OVddn of respective pixel driving circuits obtained with the last iterated operation of the calculation unit, and outputs the compensated data signal voltages Vdata1 to Vdatan corresponding to respective pixel driving circuits.

The pixel driving circuits receives the compensated data signal voltages Vdata1 to Vdatan from the compensation unit to drive the organic light emitting diode OLED to emit light.

Specifically, calculation equations that the calculation unit calculates driving currents corresponding to the power supply voltages of respective pixel driving circuits are:

$$VGS_1=\mathrm{Vdata}_i-(VS_i+\Delta VS_i) \tag{2}$$

$$VDS_i=OVdd_i-VS_i+\Delta VS_i) \tag{3}$$

$$Ids_i=K\times(VGS_i-|Vth|)^2\times(1+\lambda\cdot VDS_i) \tag{4}$$

OVddi represents power supply voltage of the ith pixel driving circuit, and Idsi represents the driving current of the ith pixel driving circuit, and K represents a configuration parameter of the drive thin film transistor in respective pixel driving circuits, and VGSi represents a gate-source voltage of the drive thin film transistor in the ith pixel driving circuit, and Vth represents a threshold voltage of the drive thin film transistor in the respective pixel driving circuits, and A represents a coefficient, and VDSi represents a source-drain voltage of the drive thin film transistor in the ith pixel driving circuit;

Vdatai represents an initial value of a data signal voltage preinputted to the ith pixel driving circuit, and VSi represents a source voltage of the drive thin film transistor in the ith pixel driving circuit, and ΔVSi represents a variation of VSi;

the calculation equation that the calculation unit reversely obtains the power supply voltages of respective pixel driving circuits according to the calculated driving currents is:

$$OVdd_i=OVdd_{i-1}-(\Sigma_{i=n,i=i-1}{}^{i}Ids_i)\times R \tag{5}$$

wherein R is an equivalent resistance of the power supply line between every two adjacent pixel driving circuits; i=1, 2, . . . n.

Furthermore, the source voltage VSi of the drive thin film transistor in the ith pixel driving circuit is a function of Vdatai, and with analog simulation; the calculation equations of a variation ΔVSi of VSi are:

$$\Delta VS_i = \Delta OVdd_i \times \frac{r_{OLED}}{r_{OLED}+r_o} \tag{6}$$

$$\text{wherein, } \Delta OVdd_i=OVdd_{i-1}-OVdd_i=(\Sigma_{i=n,i=i-1}{}^{i}Ids_i)\times R \tag{7}$$

rOLED represents an equivalent resistance of the organic light emitting diodes OLED in respective pixel driving circuits, and ro represents an equivalent resistance between the source and the drain of the driving thin film transistors in respective pixel driving circuits, which is a constant; i=1, 2, . . . n.

The compensation values for the initial values Vdata1 to Vdatan of the data signal voltages for being inputted to respective pixel driving circuits respectively are differences between the power supply voltages OVdd1 to OVddn of respective pixel driving circuits obtained with the last iterated operation of the calculation unit and the standard power supply voltage. The pixel driving circuit can be but not limited to the 2T1C structure. The pixel driving circuit shown in FIG. 8, FIG. 9 is illustrated, which comprises a switching thin film transistor T1, a driving thin film transistor T2 and a capacitor C, and a gate of the switching thin film transistor T1 is electrically coupled to a scan signal Gate, and a source is electrically coupled to a data signal Data, and a drain is electrically coupled to a gate of the driving thin film transistor T2 and one end of the capacitor C; a drain of the driving thin film transistor T2 is electrically coupled to the power supply line L, and a source is electrically coupled to an anode of the organic light emitting diode D; a cathode of the organic light emitting diode D is electrically coupled to a power supply low voltage level OVss; the one end of the capacitor C is electrically coupled to the drain of the switching thin film transistor T1 and the other end is electrically coupled to the drain of the driving thin film transistor T2.

In conclusion, in the method of compensating AMOLED IR Drop according to the present invention, many times of iterated operations are performed to the power supply voltages and the driving currents of respective pixel driving circuits coupled in series on the same power supply line, and the adjustment and compensation are performed to the initial values Vdata1 to Vdatan of the data signal voltages for being inputted to respective pixel driving circuits according to the power supply voltages OVdd1 to OVddn of respective pixel driving circuits obtained with the last iterated operation of the calculation unit, and outputs the compensated data signal voltages Vdata1 to Vdatan corresponding to respective pixel driving circuits. The method can make that the driving currents flowing through respective pixels can be more uniform for improving the brightness uniformity of an AMOLED display panel for solving the mura problem caused by IR Drop. The system of compensating AMOLED IR Drop according to the present invention can improve the brightness uniformity of an AMOLED display panel for solving the mura problem caused by IR Drop with setting the calculation unit, the storage unit, the compensation unit and the plurality of pixel driving circuits.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A method of compensating AMOLED IR Drop, comprising steps of:

step 1, providing an AMOLED display panel, comprising: a calculation unit, a storage unit, a compensation unit and a plurality of pixel driving circuits; the pixel driving circuit at least comprises two N-type thin film transistors, a capacitor and an organic light emitting diode, wherein the N-type thin film transistor coupled to the organic light emitting diode is a drive thin film transistor;

first, employing the storage unit to set power supply voltages of respective pixel driving circuits coupled in series on the same power supply line to be a standard power supply voltage, which is set to be:

$$OVdd_1=OVdd_2=\ldots=OVdd_{n-1}=OVdd_n=OVdd$$

wherein n is an integer greater than 1;

wherein $OVdd_1$, $OVdd_2$, $OVdd_{n-1}$, $OVdd_n$ respectively represent the power supply voltages of the first, the second, the n−1th, the nth pixel driving circuits, OVdd represents the standard power supply voltage;

step2, the calculation unit reads the power supply voltages of respective pixel driving circuits from the storage unit, and calculates driving currents corresponding to the power supply voltages of respective pixel driving circuits, and the calculation equations are:

$$VGS_i=\mathrm{Vdata}_i-(VS_i+\Delta VS_i)$$

$$VDS_i=OVdd_i-(VS_i+\Delta VS_i)$$

$$Ids_i=K\times(VGS_i-|Vth|)^2\times(1+\lambda\cdot VDS_i)$$

$Ids_i$ represents the driving current of the ith pixel driving circuit, and K represents a configuration parameter of the drive thin film transistor in respective pixel driving circuits, and $VGS_i$ represents a gate-source voltage of the drive thin film transistor in the ith pixel driving circuit, and Vth represents a threshold voltage of the drive thin film transistor in the respective pixel driving circuits, and λ represents a coefficient, and $VDS_i$ represents a source-drain voltage of the drive thin film transistor in the ith pixel driving circuit;

$Vdata_i$ represents an initial value of a data signal voltage preinputted to the ith pixel driving circuit, and $VS_i$ represents a source voltage of the drive thin film transistor in the ith pixel driving circuit, and $\Delta VS_i$ represents a variation of $VS_i$;

wherein i=1, 2, . . . n;

step 3, the calculation unit reversely obtains the power supply voltages $OVdd_1$ to $OVdd_n$ of respective pixel driving circuits according to the driving currents $Ids_1$ to $Ids_n$ of respective pixel driving circuits calculated in the step 2, and the calculation equation is:

$$OVdd_i=OVdd_{i-1}-(\Sigma_{i=n,i=i-1}{}^{i}Ids_i)\times R$$

wherein R is an equivalent resistance of the power supply line between every two adjacent pixel driving circuits;

then, a first iterated operation is accomplished;

then, the calculation unit stores the reversely obtained power supply voltages $OVdd_1$ to $OVdd_n$ of respective pixel driving circuits back to the storage unit;

step 4, the calculation unit calculates and compares whether a ratio of the difference $\Delta OVdd_i$ of the power supply voltages $OVdd_{i-1}$ and $OVdd_i$ of every two adjacent pixel driving circuits which are reversely obtained in the step 3, and the power supply voltage $OVdd_i$ of the ith pixel driving circuit reaches a requirement of being smaller than a specific design value, if the ratio reached, and then the power supply voltages $OVdd_1$ to $OVdd_n$ of respective pixel driving circuits are fed to the compensation unit, and then implementing the following step 5, and if not, then returning back to the step 2 and the step 3 and an iterated operation is continued to $OVdd_1$ to $OVdd_n$;

step 5, the compensation unit performs adjustment and compensation to the initial values $Vdata_1$ to $Vdata_n$ of the data signal voltages for being inputted to respective pixel driving circuits according to the power supply voltages $OVdd_1$ to $OVdd_n$ of respective pixel driving circuits obtained with the last iterated operation of the calculation unit, and outputs the compensated data signal voltages $Vdata_1$ to $Vdata_n$ corresponding to respective pixel driving circuits.

2. The method of compensating AMOLED IR Drop according to claim 1, wherein in the step 2, the source voltage $VS_i$ of the drive thin film transistor in the ith pixel driving circuit is a function of $Vdata_i$, and with analog simulation; the calculation equations of a variation $\Delta VS_i$ of $VS_i$ are:

$$\Delta VS_i=\Delta OVDD_i\times\frac{r_{OLED}}{r_{OLED}+r_o}$$

$$\text{wherein, } \Delta OVDD_i=OVdd_{i-1}-OVdd_i=\Sigma_{i=n,i=i-1}{}^{i}Ids_i)\times R$$

$r_{OLED}$ represents an equivalent resistance of the organic light emitting diodes in respective pixel driving circuits, and $r_o$ represents an equivalent resistance between the source and the drain of the driving thin film transistors in respective pixel driving circuits, which is a constant.

3. The method of compensating AMOLED IR Drop according to claim 1, wherein the method is applied in an OVDD single drive AMOLED display device or an OVDD double drive AMOLED display device.

4. The method of compensating AMOLED IR Drop according to claim 1, wherein in the step 5, the compensation values for the initial values $Vdata_1$ to $Vdata_n$ of the data signal voltages for being inputted to respective pixel driving circuits respectively are differences between the power supply voltages $OVdd_1$ to $OVdd_n$ of respective pixel driving circuits obtained with the last iterated operation of the calculation unit and the standard power supply voltage OVdd.

5. The method of compensating AMOLED IR Drop according to claim 1, wherein the pixel driving circuit comprises a switching thin film transistor, the driving thin film transistor and the capacitor, and a gate of the switching thin film transistor is electrically coupled to a scan signal, and a source is electrically coupled to a data signal after compensation, and a drain is electrically coupled to a gate of the driving thin film transistor and one end of the capacitor; a drain of the driving thin film transistor is electrically coupled to the power supply line, and a source is electrically coupled to an anode of the organic light emitting diode; a cathode of the organic light emitting diode is electrically coupled to a power supply low voltage level; the one end of the capacitor is electrically coupled to the drain of the switching thin film transistor and the other end is electrically coupled to the drain of the driving thin film transistor.

6. A system of compensating AMOLED IR Drop, comprising: a calculation unit, a storage unit, a compensation unit and a plurality of pixel driving circuits; the pixel driving circuit at least comprises two N-type thin film transistors, a capacitor and an organic light emitting diode, wherein the N-type thin film transistor coupled to the organic light emitting diode is a drive thin film transistor;

the storage unit is employed to set power supply voltages of respective pixel driving circuits coupled in series on the same power supply line to be a standard power supply voltage and stores the power supply voltages of respective pixel driving circuits calculated by the calculation unit with an iterated operation;

the calculation unit is employed to read the power supply voltages of respective pixel driving circuits from the storage unit, and calculate driving currents corresponding to the power supply voltages of respective pixel driving circuits, and reversely obtain the power supply voltages of respective pixel driving circuits according to the calculated driving currents of respective pixel driving circuits, and then store the reversely obtained power supply voltages of respective pixel driving circuits back to the storage unit; after many time iterated operations of the calculation unit, a ratio of the difference $\Delta OVdd_i$ of the power supply voltages $OVdd_{i-1}$ and $OVdd_i$ of every two adjacent pixel driving circuits which are reversely obtained, and the power supply voltage $OVdd_i$ of the ith pixel driving circuit reaches a requirement of being smaller than a specific design value, wherein i=1, 2, . . . n, and wherein n is an integer greater than 1;

the compensation unit performs adjustment and compensation to the initial values $Vdata_1$ to $Vdata_n$ of the data signal voltages for being inputted to respective pixel driving circuits according to the power supply voltages $OVdd_1$ to OVddn $OVdd_n$ of respective pixel driving circuits obtained with the last iterated operation of the calculation unit, and outputs the compensated data signal voltages $Vdata_1$ to $Vdata_n$ corresponding to respective pixel driving circuits;

the pixel driving circuits receives the compensated data signal voltages $Vdata_1$ to $Vdata_n$ from the compensation unit to drive the organic light emitting diode to emit light.

7. The system of compensating AMOLED IR Drop according to claim 6, wherein the calculation equations that the calculation unit calculates driving currents corresponding to the power supply voltages of respective pixel driving circuits are:

$$VGS_i = Vdata_i - (VS_i + \Delta VS_i)$$

$$VDS_i = OVdd_i - (VS_i + \Delta VS_i)$$

$$Ids_i = K \times (VGS_i - |Vth|)^2 \times (1 + \lambda \cdot VDS_i)$$

$OVdd_i$ represents power supply voltage of the ith pixel driving circuit, and $Ids_i$ represents the driving current of the ith pixel driving circuit, and K represents a configuration parameter of the drive thin film transistor in respective pixel driving circuits, and $VGS_i$ represents a gate-source voltage of the drive thin film transistor in the ith pixel driving circuit, and Vth represents a threshold voltage of the drive thin film transistor in the respective pixel driving circuits, and λ represents a coefficient, and $VDS_i$ represents a source-drain voltage of the drive thin film transistor in the ith pixel driving circuit;

$Vdata_i$ represents an initial value of a data signal voltage preinputted to the ith pixel driving circuit, and $VS_i$ represents a source voltage of the drive thin film transistor in the ith pixel driving circuit, and $\Delta VS_i$ represents a variation of $VS_i$;

the calculation equation that the calculation unit reversely obtains the power supply voltages of respective pixel driving circuits according to the calculated driving currents is:

$$OVdd_i = OVdd_{i-1} - (\Sigma_{i=n,i=i-1}{}^{i} Ids_i) \times R$$

wherein R is an equivalent resistance of the power supply line between every two adjacent pixel driving circuits.

8. The system of compensating AMOLED IR Drop according to claim 7, wherein the source voltage $VS_i$ of the drive thin film transistor in the ith pixel driving circuit is a function of $Vdata_i$, and with analog simulation; the calculation equations of a variation $\Delta VS_i$ of $VS_i$ are:

$$\Delta VS_i = \Delta OVDD_i \times \frac{r_{OLED}}{r_{OLED} + r_o}$$

wherein, $\Delta OVDD_i = OVdd_{i-1} - OVdd_i = (\Sigma_{i=m,i=i-1}{}^{i} Ids_i) \times R$ $r_{OLED}$ represents an equivalent resistance of the organic light emitting diodes in respective pixel driving circuits, and $r_o$ represents an equivalent resistance between the source and the drain of the driving thin film transistors in respective pixel driving circuits, which is a constant.

9. The system of compensating AMOLED IR Drop according to claim 6, wherein the compensation values for the initial values $Vdata_1$ to $Vdata_n$ of the data signal voltages for being inputted to respective pixel driving circuits respectively are differences between the power supply voltages $OVdd_1$ to $OVdd_n$ of respective pixel driving circuits obtained with the last iterated operation of the calculation unit and the standard power supply voltage.

10. The system of compensating AMOLED IR Drop according to claim 6, wherein the pixel driving circuit comprises a switching thin film transistor, the driving thin film transistor and the capacitor, and a gate of the switching thin film transistor is electrically coupled to a scan signal, and a source is electrically coupled to a data signal after compensation, and a drain is electrically coupled to a gate of the driving thin film transistor and one end of the capacitor; a drain of the driving thin film transistor is electrically coupled to the power supply line, and a source is electrically coupled to an anode of the organic light emitting diode; a cathode of the organic light emitting diode is electrically coupled to a power supply low voltage level; the one end of the capacitor is electrically coupled to the drain of the switching thin film transistor and the other end is electrically coupled to the drain of the driving thin film transistor.

11. A system of compensating AMOLED IR Drop, comprising: a calculation unit, a storage unit, a compensation unit and a plurality of pixel driving circuits; the pixel driving circuit at least comprises two N-type thin film transistors, a capacitor and an organic light emitting diode, wherein the N-type thin film transistor coupled to the organic light emitting diode is a drive thin film transistor;

the storage unit is employed to set power supply voltages of respective pixel driving circuits coupled in series on the same power supply line to be a standard power supply voltage and stores the power supply voltages of respective pixel driving circuits calculated by the calculation unit with an iterated operation;

the calculation unit is employed to read the power supply voltages of respective pixel driving circuits from the storage unit, and calculate driving currents corresponding to the power supply voltages of respective pixel driving circuits, and reversely obtain the power supply voltages of respective pixel driving circuits according to the calculated driving currents of respective pixel driving circuits, and then store the reversely obtained power supply voltages of respective pixel driving circuits back to the storage unit; after many time iterated operations of the calculation unit, a ratio of the difference $\Delta OVdd_i$ of the power supply voltages $OVdd_{i-1}$ and $OVdd_i$ of every two adjacent pixel driving circuits which are reversely obtained, and the power supply voltage $OVdd_i$ of the ith pixel driving circuit reaches a requirement of being smaller than a specific design value, wherein i=1, 2, . . . n, and wherein n is an integer greater than 1;

the compensation unit performs adjustment and compensation to the initial values $Vdata_1$ to $Vdata_n$ of the data signal voltages for being inputted to respective pixel driving circuits according to the power supply voltages $OVdd_1$ to $OVdd_n$ of respective pixel driving circuits obtained with the last iterated operation of the calculation unit, and outputs the compensated data signal voltages $Vdata_1$ to $Vdata_n$ corresponding to respective pixel driving circuits;

the pixel driving circuits receives the compensated data signal voltages $Vdata_1$ to $Vdata_n$ from the compensation unit to drive the organic light emitting diode to emit light;

wherein the calculation equations that the calculation unit calculates driving currents corresponding to the power supply voltages of respective pixel driving circuits are:

$$VGS_i = Vdata_i - (VS_i + \Delta VS_i)$$

$$VDS_i = OVdd_i - (VS_i + \Delta VS_i)$$

$$Ids_i = K \times (VGS_i - |Vth|)^2 \times (1 + \lambda \cdot VDS_i)$$

$OVdd_i$ represents power supply voltage of the ith pixel driving circuit, and $Ids_i$ represents the driving current of the ith pixel driving circuit, and K represents a configuration parameter of the drive thin film transistor in respective pixel driving circuits, and $VGS_i$ represents a gate-source voltage of the drive thin film transistor in the ith pixel driving circuit, and Vth represents a threshold voltage of the drive thin film transistor in the respective pixel driving circuits, and A represents a coefficient, and $VDS_i$ represents a source-drain voltage of the drive thin film transistor in the ith pixel driving circuit;

$Vdata_i$ represents an initial value of a data signal voltage preinputted to the ith pixel driving circuit, and $VS_i$ represents a source voltage of the drive thin film transistor in the ith pixel driving circuit, and $\Delta VS_i$ represents a variation of $VS_i$;

the calculation equation that the calculation unit reversely obtains the power supply voltages of respective pixel driving circuits according to the calculated driving currents is:

$$OVdd_i = OVdd_{i-1} - (\Sigma_{i=n, i=i-1}{}^{i} Ids_i) \times R$$

wherein R is an equivalent resistance of the power supply line between every two adjacent pixel driving circuits;

wherein the compensation values for the initial values $Vdata_1$ to $Vdata_n$ of the data signal voltages for being inputted to respective pixel driving circuits respectively are differences between the power supply voltages $OVdd_1$ to $OVdd_n$ of respective pixel driving circuits obtained with the last iterated operation of the calculation unit and the standard power supply voltage;

wherein the pixel driving circuit comprises a switching thin film transistor, the driving thin film transistor and the capacitor, and a gate of the switching thin film transistor is electrically coupled to a scan signal, and a source is electrically coupled to a data signal after compensation, and a drain is electrically coupled to a gate of the driving thin film transistor and one end of the capacitor; a drain of the driving thin film transistor is electrically coupled to the power supply line, and a source is electrically coupled to an anode of the organic light emitting diode; a cathode of the organic light emitting diode is electrically coupled to a power supply low voltage level;

the one end of the capacitor is electrically coupled to the drain of the switching thin film transistor and the other end is electrically coupled to the drain of the driving thin film transistor.

12. The system of compensating AMOLED IR Drop according to claim 11, wherein the source voltage $VS_i$ of the drive thin film transistor in the ith pixel driving circuit is a function of $Vdata_i$, and with analog simulation; the calculation equations of a variation $\Delta VS_i$ of $VS_i$ are:

$$\Delta VS_i = \Delta OVDD_i \times \frac{r_{OLED}}{r_{OLED} + r_o}$$

wherein, $\Delta OVDD_i = OVdd_{i-1} - OVdd_i = (\Sigma_{i=n,i=i-1}{}^{i}Ids_i) \times R$ $r_{OLED}$ represents an equivalent resistance of the organic light emitting diodes in respective pixel driving circuits, and $r_o$ represents an equivalent resistance between the source and the drain of the driving thin film transistors in respective pixel driving circuits, which is a constant.

* * * * *